United States Patent [19]

Beyer et al.

[11] 4,288,760

[45] Sep. 8, 1981

[54] STRIP LINE DIRECTIONAL COUPLER

[75] Inventors: Franz Beyer; Peter Schucht, both of Munich, Fed. Rep. of Germany

[73] Assignee: Siemens Aktiengesellschaft, Berlin & Munich, Fed. Rep. of Germany

[21] Appl. No.: 71,540

[22] Filed: Aug. 31, 1979

[30] Foreign Application Priority Data

Sep. 1, 1978 [DE] Fed. Rep. of Germany ..... 2838317

[51] Int. Cl.[3] ..... H01P 5/18

[52] U.S. Cl. ..... 333/116; 333/238

[58] Field of Search ..... 333/116, 25, 26, 238, 333/246; 455/325, 327

[56] References Cited

U.S. PATENT DOCUMENTS

| | | | |
|---|---|---|---|
| 3,611,153 | 10/1971 | Wen | 333/116 X |
| 3,842,360 | 10/1974 | Dickens | 333/238 X |
| 3,995,239 | 11/1976 | Head et al. | 333/246 X |

OTHER PUBLICATIONS

Podell, *A High Directivity Microstrip Coupler Technique,* G-MTT 1970 Int'l. Microwave Symposium, May 11-14, 1970.

*Primary Examiner*—Paul L. Gensler

*Attorney, Agent, or Firm*—Hill, Van Santen, Steadman, Chiara & Simpson

[57] ABSTRACT

A directional coupler formed as a strip line which consists of two transmission lines coupled to each other and formed on opposite surfaces of a dielectric carrier plate with one of the lines comprising a microstrip line. A directional coupler is formed which has very high sharpness of directivity and high coupling attenuation, and great electrical strength. The second transmission line is formed as a coplanar line which includes a strip line which is mounted on the grounded side of the microstrip line in an area which is free of the grounded line surface and which extends essentially parallel and has current which is opposite to the strip line of the microstrip line. The invention is particularly adaptable for use where a directional coupler having high coupling attenuation is required, as, for example, in VSWR monitoring in secondary radar devices.

8 Claims, 6 Drawing Figures

STRIP LINE DIRECTIONAL COUPLER

BACKGROUND OF THE INVENTION

1. Field of the Invention

This invention relates in general to directional couplers and in particularly to a directional coupler formed in strip line technique.

2. Description of the Prior Art

Directional couplers formed in strip line technology are known which consist of two strip lines applied to a surface of a dielectric carrier and extend parallel to each other which strip lines form two microstrip lines with the grounded backside of the dielectric supporting plate. Electrical and magnetic coupling exists between these two microstrip lines. Such a directional coupler arrangement in microstrip technology is described in the article by Bryant, Weiss in IEEE Transactions MTT-16, pages 1021–1027 of December 1968. However, such device has very poor sharpness of directivity particularly at high coupling attenuations.

So as to improve the sharpness of directivity which assures better confirmation of the velocity in the in-phase and push-pull waves, there are a number of possible solutions. For example, the article by H. J. Herzog in the Electronics Letters, Volume 14, page 50, No. 3, Feb. 2, 1978 discloses loading all four coupling points of the microstrip directional coupler by means of parallel capacitances. Another possible embodiment of a microstrip directional coupler is disclosed in the article by G. Schaller in AEÜ Volume 26, No. 11, 1972, pages 508–509 wherein a capacitive coupling between the two coupled lines exist at their outputs. The design of the coupling section has a graduation of directional couplers with different coupling attenuations and different lengths is discussed in the article by S. Rehnmark, IEEE Transactions MTT-25, pages 1116– 1121 of December, 1977. A sawtooth shaped arrangement for the coupling section is described in the article by A. Podell, 1970 G-MTT, International Microwave Symposium Digest. The application of overlays on the coupling section is described in an article by B. Sheleg and B. E. Spielman in IEEE Transactions MTT-22, pages 1216–1220 of December 1974. The employment of special anisotropic substrate material is disclosed in the article by N. G. Alexopoulos, C. M. Krowne in the periodical IEEE Transactions MTT-26, pages 387–393 of June 1978. An arrangement of a slit on the grounded side of two coupled microstrip lines is disclosed in the article by M. Aikawa in Transactions of the IECE of Japan, Volume E. 60, No. 4, pages 206–207 of April 1977.

In all of these known directional coupler arrangements in microstrip technology, the demands for a high electrical strength, a high coupling attenuation and at the same time for independence of sharpness of directivity for various housing dimensions are not satisfactorily met.

A directional coupler formed in strip line techniques is described in German A.S. No. 21 02 554 wherein one transmission line is designed as a microstrip line and the other transmission line is designed as a slit line. This strip line is formed by means of a narrow gap dividing the grounded conductor surface of the microstrip line with the gap arranged opposite the strip line of the microstrip line in such a manner that the longitudinal radii of the strip line and of the gap enclose a small angle of crossing which differs from zero. In this structure, however, difficulties in the series connection of components and upon transition to a microstrip line are encountered. Also, in such a slit line embodiment of a directional coupler, a significant leakage field occurs. Transmission down to the zero frequency is not possible with this arrangement.

SUMMARY OF THE INVENTION

The present invention relates to a directional coupler formed in strip line techniques and can be constructed into a housing consisting of two transmission lines coupled to each other and applied to opposite surfaces of a dielectric supporting plate with the ends of the transmission lines forming the connecting points and one of the transmission lines designed as a microstrip line with a strip line on one surface of the dielectric supporting plate and a grounding line surface on the opposite surface of the supporting plate.

An object of the invention is to provide a directional coupler arrangement formed in planar technology which has a high sharpness of directivity and a high coupling attenuation, great electrical strength and has a high degree of insensitivity of these properties so that it can be built into a housing and which overcomes the disadvantages of the directional coupler arrangement known in German A.S. No. 21 02 554.

The object of the invention is achieved according to the invention which relates to a directional coupler in that the second transmission line is formed as a coplanar line which forms a strip line inserted on the grounded side of the microstrip line in an area free of the grounded line surface and extends essentially parallel and in the opposite direction to the strip line of the microstrip line.

With high coupling attenuations, the arrangement according to the invention produces a very low dependence of the sharpness of directivity on the housing. It also can be very easily produced. It has a definite advantage over the slit line described in German A.S. No. 21 02 554 in that the coplanar line allows for easy series connections of components and a more efficient transition to a microstrip line. The coplanar line also has lower leakage field than the slit line and allows transmission up to zero frequency.

Other objects, features and advantages of the invention will be readily apparent from the following description of certain preferred embodiments thereof taken in conjunction with the accompanying drawings, although variations and modifications may be effected without departing from the spirit and scope of the novel concepts of the disclosure and in which:

DESCRIPTION OF THE PREFERRED EMBODIMENTS

Figure 1:
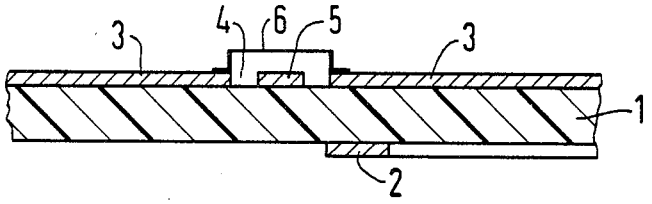
FIG. 1 is a cross-sectional view of a directional coupler according to the invention taken on line I—I from FIG. 2.
Figure 2:
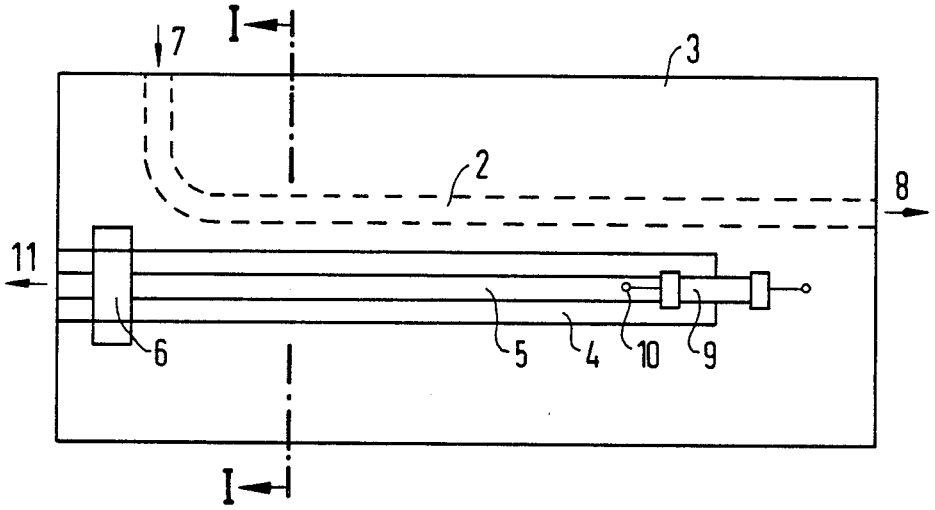
FIG. 2 is a top plan view of the directional coupler illustrated in FIG. 1.

FIGS. 1 and 2 illustrate the invention with FIG. 2 being a top plan view and FIG. 1 being a sectional view taken on line I—I from FIG. 2. A supporting plate 1 of suitable dielectric material has a strip line 2 attached to one surface which is the lower surface relative to FIGS. 1 and 2 and the upper or other surface of the dielectric material 1 is covered with a grounded line surface 3. The surface 3 and line 2 may be formed of copper or other suitable conductor materials. The strip line 2 and the grounded line surface 3 form a microstrip line.

On the upper surface relative to FIGS. 1 and 2, and extending substantially parallel to strip line 2 and in the opposite direction a surface area 4 is removed from the grounded line surface 3 and in the bare area on the surface of the dielectric material 1 a second strip line 5 is formed of copper or other suitable material. The further strip line 5 in combination with the grounded line surface 3 forms a coplanar line. The free area 4 is bridged at one location by means of a ground bridge 6 of electrical conducting material and in the embodiment illustrated in FIGS. 1 and 2 the ground bridge is shown to the left of FIG. 2. Waves follow paths from the first coupling point 7 to the second coupling point 8 along the strip line 2 of the microstrip line and are coupled into the coplanar line comprising the strip line 5 mounted in the grounded line surface 3 of the microstrip line. The microstrip line 5 terminates at a connecting point 10 with a terminating impedance 9. The wave that is coupled out from the strip line 5 is supplied at a connecting point 11 from the strip line of the coplanar line which is at the left of the FIG. 2.

It is to be noted that the strip line 2 extends parallel to the strip line 5 on opposite sides of the dielectric material 1 and in the embodiment illustrated, the strip line 5 is offset slightly relative to the strip line 2.

Figure 3:
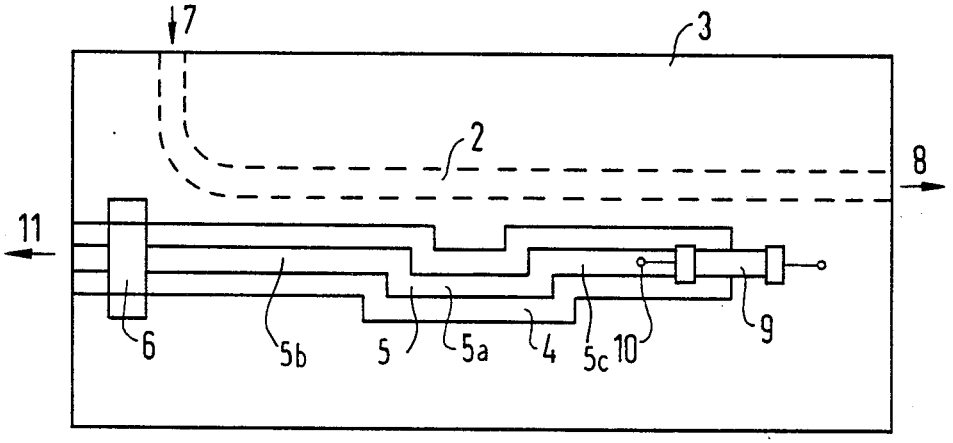
FIG. 3 is a top view of a directional coupler according to the invention which has a meandering coupling line.

A modification of the invention is illustrated in FIG. 3 wherein like portions are designated by similar numbers and in this embodiment the strip line 5 and the removed portion 4 from the grounding surface 3 are formed so that the strip line 5 meanders as is shown by the offset portion 5*a* which is slightly offset from the remaining portions 5*b* and 5*c* of the strip line 5 as shown. This effectively gives the strip line 5 a greater length.

It is to be realized, of course, also that the strip line 2 can also be provided with offsets and meander if desired.

Thus, the strip line 2 can meander so that it has the same appearance of the line 5*a*, 5*b* and 5*c* illustrated in FIG. 3 and both or either of the lines 5 and 2 could be formed to be sawtooth shaped or zig-zag shaped.

Figure 4:
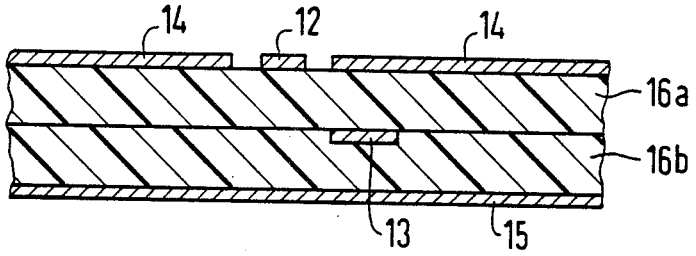
FIG. 4 is a cross-sectional view of a modification of the invention formed in triplate technology.

Another embodiment of the invention is illustrated in FIG. 4 in sectional view wherein a pair of dielectric plates 16*a* and 16*b* are connected together with a strip line 13 formed in the surface which joins them. On the top surface, relative to FIG. 4, a strip line 12 is formed on the upper surface in an opening formed in the grounding conductor plane 14. The strip line 13 of the triplate line is mounted at the junction between the surfaces of the dielectric 16*a* and 16*b* and between the two ground line surfaces 14 on the top surface and 15 on the bottom surface of the dielectric layer 16*b* as shown. The strip line 12 and the strip line 13 may extend in straight lines or alternatively they can meander or be formed in sawtooth shaped form as desired.

Figure 5:
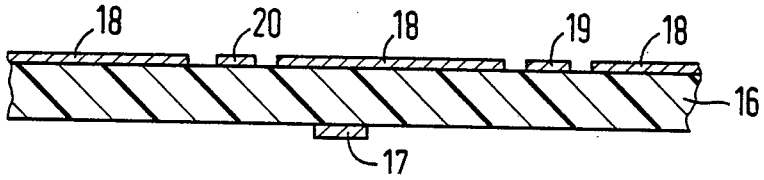
FIG. 5 is a sectional view illustrating two mutually independent directional couplers formed according to the invention.

FIG. 5 illustrates a directional coupler applied to a dielectric carrier plate 16 for coupling a microstrip line consisting of the strip line 17 formed on the lower surface relative to FIG. 5 of the plate 16 and the grounded line surface 18 on the upper surface relative to FIG. 5. Two strip lines 19 and 20 are formed in openings in the grounded line surface 18 on the surface of the dielectric carrier plate 16 as shown.

Figure 6:
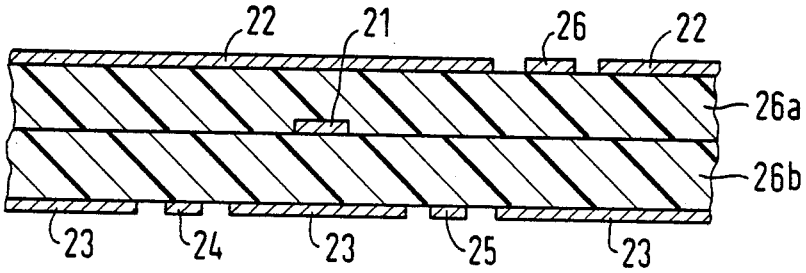
FIG. 6 comprises a sectional view of a three-fold directional coupler according to the invention formed in triplate technology.

FIG. 6 illustrates a further embodiment of a triplate line consisting of a strip line 21 formed between the engaging surfaces of dielectric plates 26*a* and 26*b* and on the opposite surfaces of these dielectric plates 26*a* and 26*b* are formed grounding plates 22 and 23, respectively, as illustrated. The grounding plate 22 is formed with open areas in which the strip line 26 is formed as shown and which extends parallel to the strip line 21. The grounded plate 23 is formed with a pair of open surfaces in which strip lines 24 and 25 are formed as shown. In the embodiment of FIG. 6, the simultaneous coupling of the triplate line consisting of the strip line 21 and the grounded line surfaces 22 and 23 is made to three coplanar lines comprising the strip lines 24, 25 and 26 and in this embodiment two strip lines are formed on the surface of plate 26*b* and only one strip line 26 is formed on the surface of dielectric plate 26*a*.

It is to be realized, of course, that in the embodiments illustrated in FIG. 4 that the lines 12 and 13 extend parallel to each other in a manner analogous to strip lines 2 and 5 in FIGS. 1 through 3. In a like manner in FIG. 5 strip lines 17, 19 and 20 extend parallel to each other as do strip lines 21, 26, 24 and 25 in the embodiment of FIG. 6.

Although the invention has been described with respect to preferred embodiments, it is not to be so limited as changes and modifications can be made which are within the full intended scope of the invention as defined by the appended claims.

We claim as our invention:

1. A directional coupler capable of being built in strip line technology, comprising two transmission lines coupled to each other and formed on opposite surfaces of a dielectric supporting plate and the ends of said transmission lines forming connecting points and with one transmission line formed as a microstrip line with a first strip line on one surface of said dielectric supporting plate and an electrical conducting grounded line surface formed on the opposite surface of said supporting plate, and wherein the other one of said transmission lines is formed as a coplanar line and comprises a second strip line (5) mounted on said opposite surface of said supporting plate in an area (4) which is free of said grounded line surface (3) and wherein said second strip line (5) is essentially parallel to said first strip line (2) of the microstrip line and wherein said second strip line (5) and said first strip line (2) are positioned on said dielectric plate such that energy is coupled between them along their lengths so that a directional coupler is formed.

2. A directional coupler according to claim 1, wherein the area (4) free of the grounded line surface (3) is electrically bridged with an electrical conducting ground bridge (6).

3. A directional coupler according to claim 2, wherein the coplanar line is formed to meander (5*a*, 5*b* and 5*c*).

4. A directional coupler according to claim 1 formed in triplate technology and including a second dielectric supporting plate with one surface attached to said first supporting plate on the surface which carries said first strip line, and a second electrical conducting grounded line surface formed on the other surface of said second supporting plate.

5. A directional coupler according to claim 4 including third and fourth strip lines attached to the other surface second of said supporting plate in areas free of said second electrical conducting grounded line surface.

6. A directional coupler according to claim 5, wherein said third and fourth strip lines are substantially parallel to said first and second strip lines.

7. A directional coupler according to claim 1 comprising a third strip line formed on said opposite surface within an area which is free of said grounded line surface to form a second coplanar line.

8. A directional coupler according to claim 7, wherein said third strip line is substantially parallel to said first and second strip lines.

* * * * *